US006327711B1

(12) United States Patent
Fujiwara

(10) Patent No.: US 6,327,711 B1
(45) Date of Patent: Dec. 11, 2001

(54) STRIP FOR PROVIDING SIMPLIFIED TYPE GARMENTS AND METHOD FOR PROVIDING GARMENTS

(75) Inventor: Toshio Fujiwara, Tokyo (JP)

(73) Assignee: Kabushiki Kaisha Miyake Design Jimushon, Tokyo (JP)

( * ) Notice: Subject to any disclaimer, the term of this patent is extended or adjusted under 35 U.S.C. 154(b) by 0 days.

(21) Appl. No.: 09/616,438

(22) Filed: Jul. 14, 2000

(30) Foreign Application Priority Data

Oct. 4, 1999 (JP) ..... 11-282863

(51) Int. Cl.[7] ..... A41D 3/08
(52) U.S. Cl. ..... 2/69; 2/88; 2/243.1
(58) Field of Search ..... 2/69.88, 84, 114, 2/243.1, 115, 95, 85, 80, 83, 79

(56) References Cited

U.S. PATENT DOCUMENTS 3,229,875 * 1/1966 Stoller ..... 2/69
3,665,518 * 5/1972 Leadford ..... 2/88
3,781,916 * 1/1974 Vitol ..... 2/88
3,849,803 * 11/1974 Connors ..... 2/84
3,946,443 * 3/1976 Knight ..... 2/84
4,118,802 * 10/1978 Polster ..... 2/84
4,258,438 * 3/1981 Kirchner ..... 2/46
4,313,229 * 2/1982 Villafane ..... 2/84
4,390,096 * 6/1983 Goldenberg ..... 206/390
5,099,526 * 3/1992 Baena ..... 2/88

OTHER PUBLICATIONS

Japanese Patent Application Publication No. S52–12306.
Japanese Utility Model Application Publication No. S54–11053.
Japanese Utility Model Application Publication No. S62–153304.

* cited by examiner

*Primary Examiner*—Gloria M. Hale
(74) *Attorney, Agent, or Firm*—Pitney, Hardin, Kipp & Szuch LLP

(57) ABSTRACT

A strip 10 for separating therefrom rain ponchos 1. The strip 10 has units 11 which is repeated along the length of the strip 10. The strip 10 has superimposed layers which are thermally welded along outlines of garments and has cut lines 2 which are adjacent to the respective outlines of the ponchos 1. For a supply to a customer, a unit 11 is separated from the strip along a notched line 3 between the units, and a separation of a poncho 1 is done by cutting along the cutting line 2.

2 Claims, 4 Drawing Sheets

STRIP FOR PROVIDING SIMPLIFIED TYPE GARMENTS AND METHOD FOR PROVIDING GARMENTS

BACKGROUND OF THE INVENTION

1. Field of the Invention

The present invention relates to a strip, which is capable of integrally holding thereon a plurality of garments and capable of providing, in a simplified way, garments and relates, also, to a method therefor. In more particularly, the present invention relates to a strip, which is capable of producing a large number of garments under a low cost and is capable of providing such garments without necessitating substantial space and relates, also, to a method therefor. Furthermore, the present invention relates to a strip, which is capable of providing rain ponchos at various sites under easy way as well as at a low cost.

2. Description of Related Art

In view of recent various requirements in a consumer's market, garments of various forms and of various materials have been provided. However, as to a provision of garments to customers, a conventional way has still been taken in various shops, wherein the garments are displayed under a neatly sorted condition while keeping the goods separately by using covers. In a conventional method for a production of such garments, various processes such as sewing process and size adjustment process are needed prior to the completion of the production of the garments. Furthermore, after the completion of the production of the garments, various subsequent processes are also needed, such as a process for wrapping the garments under a separated manner and a process for attaching thereon tags on which a code number is printed for identifying the goods and/or labels indicating the prices of the goods. Furthermore, in order to prevent the goods from being damaged as well as in order to prevent its value from being lost, an increased degree of carefulness is required in a packing of the wrapped goods and their transportation. Furthermore, at shops whereat the goods are sold to customers, a substantial space is required for keeping a large amount of goods which are to be handled at the shops, resulting in an increase in a selling price. Furthermore, an increased amount of works is always required in displaying the goods in a shop under a neatly sorted condition. Namely, after a visit of a customer to a shop to examine goods, it is quite usual that the goods are highly disordered, which may forces endless and repeated works to restore the messed condition to the neatly sorted condition.

In short, due to the above mentioned problems regarding the available space as well as the increased works at a shop, a limitation has still been existed from the view point of handling an increased amount of goods.

Furthermore, a handling and a keeping of garments usually requires excessive skill as well as works. Thus, a provision of garments is usually limited to a department store or specialty shop. In other words, a provision of garments is not usually done as at conveniences store or kiosks whereat wide variety of goods are available in a very convenient manner. Thus, a circumstance has still not been realized that a desired garment can be easily and conveniently obtained in a situation when it is needed by an emergency purpose or even by capricious mind of an user.

An example of a kind of garment which is frequently urgently needed is a rain court or rain poncho. As for the rain court or rain poncho, a simplified type has been conventionally used for a preparation to a situation such as a sudden shower of rain. In particular, a rain poncho made of a material based on polyvinyl chloride has been provided, which is mainly intended to a use for a sudden rain during a mount climbing or playing golf or for an emergency use such as a disaster.

However, even such a simplified type of a rain poncho or court, its production is also done under a process which is quite similar to that for producing a usual type of garment, in which a fabric is cut along pattern papers corresponding, respectively, to front and back bodies, sleeves and a hood, and then the cut pieces are, along their outer edge portions, connected with each other by a contact bonding or sewing, thereby obtaining a garment. Thus, the complicated process including cutting and sewing causes an amount of works to be increased and to be prolonged, resulting in an increase in a production cost. Furthermore, in the prior art, the portions of the rain poncho such as sleeves and hood are made bulky, so that an increased amount of works is necessary in order to make it to be neatly folded condition in order to allow the good to be wrapped to a bag. Furthermore, even under the wrapped state, some kind of bulkiness is essential, which makes its transportation to be difficult.

Although various types of simplified type garments for a mere temporal or disposable use, such as a rain poncho have been heretofore existed as mentioned above, the construction of these garments are too sophisticated and cost is too high in view of the purpose of their temporally use. Furthermore, from the view point of a product transportation, a large space is occupied, so that there is a limitation in a number of goods to be held at a shop as stocks.

Finally, for a customer, the prior art poncho is not the one that is available anywhere once it starts to rain but the one which should be, in advance, prepared for use in abrupt start of a rain. Namely, the prior art simplified type rain poncho is not the one which is conveniently helpful for the emergency use.

SUMMARY OF THE INVENTION

An object of the present invention to provide a garment which is capable of producing at a low cost and is capable of feeding to customers under a convenient way.

Another object of the present invention is to provide a garment of low cost and of a low weight, which is suitable for a mass production, while being suitable for its disposal after the use in view point of protection of an environment.

Still another object of the present invention is to provide a garment, which has possibility of size adjustment so as to allow it to be matched to wide range of size of a wearer.

Further another objet of the present invention is to provide a possibility wherein, together with a provision of a garment, other attachments, such as gloves, shoe's cover and a bag are simultaneously provided.

Further object of the present invention is to provide a garment, in particular, a rain poncho, which is easy for its keeping while a space utility is high, is capable of being kept and provided at wide variety of types of shops, and is available instantly when its abrupt need is arisen.

According to the present invention, a strip is provided Ofor cutting therefrom garments, comprising:

at least two superimposed layers extending in a direction of a length of the strip;

outlines of garments on the strip, which are repeated at least along the length of the strip and which are welded portions which thermally weld the superimposed layers with each other at least partially along said outlines of garments, and;

cutting lines provided along the outlines so that they are spaced outwardly from the respective outlines;

According to another aspect of the present invention, a strip is provided for cutting therefrom garments, said strip comprises:

at least two superimposed layers extending in a direction of a length;

a plurality of units on the strip arranged along the length thereof, said units being separable with each other;

welded portions provided at each of said units, whereat the superimposed layers are, along an outline of a garment, at least partially, thermally welded with each other, and;

a cutting line provided along each of the outlines;

thereby providing garments in a sequential manner by allowing the strip to be cut under unit to unit basis and by, in each unit, separating a garment by cutting along the respective cutting line.

Each of said layers may be formed as a longitudinally extending film.

Each of said layers may be formed as a woven or non-woven or knitted fabric including a thermally soluble material, thereby allowing the superimposed layers to be thermally welded with each other.

Preferably, the strip is under a rolled condition for its supply. Namely, in order to cause garments to be displayed and/or to make them to be fed to customers, the leading end of the strip is merely pulled out from the roll and garments to be cut out. After the use, the strip can be conveniently returned to the original rolled condition.

Preferably, said strip may be made of a compost material having a water repellant capacity. Since the present invention is intended for a disposable use, this solution is desirable from the view point of environmental protection view point.

Preferably, the strip according to the present invention further comprises notched lines between units which are adjacent with each other, thereby making it easy that the units are separated from each other.

The welded portions between the layers may comprise the ones as obtained by ultrasonic vibration heat generation welding.

According to the present invention, said strip is formed as a tube, which is flattened.

The strip according to the present invention may further comprises, at each of the units or components, a plurality of parallel cut lines at the area of sleeves and/or hemline or base of a garment, thereby allowing a stepwise adjustment of the sleeve length or body length of the garment in accordance with a size of a wearer.

According to the present invention, the strip may further comprises, at marginal portions, additional welded portions, which run along an outline, which corresponds to that of an attachment article such as gloves, a shoe's cover or a bag. This modification is advantageous in that it can be accommodated for various purpose such as a use in an excursion or an equipment for a disaster.

According to the present invention, said garment is a rain poncho having a hood at its top. Preferably, the strip further comprises, at a layer, a slit which allows a wearer to make his or her face to be exposed from the food. This structure allows the simplified type rain ponchos to be available at various kinds of shops, which is advantageous from the view point for the use in an abrupt rain fall or an emergency such as an occurrence of a disaster.

According to the second aspect of the present invention, a method is provided, for providing a garment, comprising the steps of:

providing a length of strip having at least two superimposed layers extending in a direction of a length;

forming a plurality of units on the strip along the length thereof in such a manner that said units are separable with each other;

thermally welding, at each of the units, the superimposed layer with each other along an outline of a garment, while forming a cut line along said outline, and;

separating a unit from the strip, which is followed by cutting the separated unit along the cut line, thereby separating a garment.

According to the present invention, the method further comprises the steps of:

winding the strip to a rolled condition after execution of the welding step, and;

unfolding the rolled strip so that said separating and cutting step is executed orderly from the unfolded end of the roll.

Now, the present invention will be explained in more detail. The strip according to the present invention has two or more superimposed layers extending longitudinally. In order to obtain such superimposed layers, the two or more sheets, which are separate from each other, are superimposed. As an alternative way, a tubular sheet of thin film is flattened, so that superimposed two layers are obtained. The above mentioned first and second possibilities may be combined if necessary.

The strip material is formed with outlines of garments, which are constructed by bonding or welding the flattened upper and lower layers with each other. In the case of a sweat shirt as a garment, the outline is formed by connecting the upper and lower layers along portions from shoulders to sides of body. The remaining non-connected portions function as a neck or a body or sleeves. Furthermore, a cut line is formed along and outwardly from the outline, which cut line makes it easy that a garment is separated from the strip material. In case where the bonded parts along the outline have a predetermined width, such a cut line can be formed in the connecting parts rather than outwardly from the connecting parts.

By a provision of the cut line, a garment can be easily separated from the strip. The separated garment is constructed by layers which are partially bonded along an outline of the garment, so that a space is formed between the layers, while the space is connected to the outside atmosphere via the neck or sleeve portions, at which the layers are not bonded, which allows a wearer to wear the garment. As a modification of the invention, an arrangement is possible wherein the connection between the layers extends entirely along the outline of the garment. In the latter case, cut lines are provided for removing unnecessary connected portions, so that a garment having opened portions such as sleeve portions can be obtained. It is also possible that the strip is, at marginal portions, provided with attachment parts for garments such as gloves, shoe's covers and a bag. These attachment parts can be formed in the similar way as the garments.

Along the elongation of the strip, a plurality of garments of the same shape or a group of related garments or attachment parts are formed under a consecutive manner. In other words, the present invention makes it possible that, from the elongated strip, a plurality of garments of the same shape or a group of types of garments can be provided under a sequential manner. In order to make it possible that the each of garments or the group of garments are fed to customers, laterally extending notched lines may be formed on the strip in such a manner that units, each of which is constructed by a garment or a garment group, are separated by the notched lines. As a result, these units can be separated under unit to unit basis. In other words, a supply to customers is done by separating the strip under unit to unit basis of a rectangular shape. A user can carry the unit under a folded state, and a garment, when needed by the user, can be separated from the strip by breaking the unit along the cut line.

The strip is basically constructed by two layers. However, characteristics for a garment such as a durability, a heat resistance property and heat retaining property are changed in accordance with the kinds of the strip. Thus, a garment may, depending on the property as required or the purpose for use, have three or more layers. Furthermore, a further layer of different color can be added and bonded in such a manner that attachment parts, such as a pocket is additionally created.

The strip of superimposed structure is of an elongated flattened shape, which allows the strip to be wound to rollsO. Such rolls of the strip are stored and are delivered to shops when required, which allows the efficiency to be highly increased in the production as well as in administration in stocks at a shop. Furthermore, at a store, a supply of a garment to a customer is done by unrolling the strip, which is followed by separation of a unit from the unrolled strip. When a notched lines are provided between the units which are adjacent with each other, the separation of the unit is done along the notched line. Contrary to this, when such a notched line is not provided, a cutting tool such as scissors is used, so that a unit including a garment or a group of garment is separated. Furthermore, at the marginal region in the unit, desired attachment parts such as gloves, shoe's covers and a bag can be formed. In view of the above, the present invention makes it possible that many kinds of goods as desired can be integrated to a unit of the strip.

The strip can be produced by one of organic materials, which can be thermally welded while being formed so that it extend longitudinally, such as a polyvinyl chloride, polyester, nylon, polyolefine and rayon et al, or a combination of such organic materials or a combination of the organic material with a non-organic material such as a carbon, or a compost material which is dissolved by a microorganism which is suitable for a view point of environmental protection.

The strip may be an elongated film. The strip is, for example, formed as an elongated tube, which is flattened so that it forms superimposed layers. As an alternative, in order to obtain a strip according to the present invention, a flattened film is, first, formed, which is folded along a longitudinal line, thereby obtaining superimposed layers. In this last alternative, the strip has an integrated structure, which is advantageous in an entirely even structure as well as a simplified process for its making. As a further alternative, in order to make a superimposed structure of the strip according to the present invention, films of the same width, which are separate from each other, are combined. In this last alternative, different materials can be used between the layers, which makes it possible that different treatment for surfaces or colors are combined.

Furthermore, the strip according to the present invention may be a sheet of woven or non-woven or knitted fabric. In order to obtain such superimposed layer structure according to the present invention, a tubular woven or non-woven or knitted fabric is formed, which is, then, flattened. As an alternative, sheets of fabrics are prepared, which are then superimposed.

The fabric constructing the strip according to the present invention is incorporated with a material which is thermally molten, which causes the layers to be thermally welded or bonded with each other. The welded fabric is, by the method as already explained, subjected to cutting along the cutting line, which allows a garment to be separated. In order to make the thermally soluble (welded) material to be incorporated with the fabric, fibers constructing the fabric are made of thermally soluble material, such as synthetic resin. As an alternative, it is possible that thermally soluble fibers are combined with a fabric, which allows the fabric to be thermally weldable. As a further modification for providing a sheet of fabric having a thermal weldability, a thermally weldable material can be impregnated or coated to the woven or non-woven or knitted fabric.

The bonding between the films and sheets constructing the layers is done by applying heat to the portions of the layers to be bonded. Since the films or sheets as strip include hot melt material, which allows the layers to be welded with each other. The cut line for allowing garments to be separated is formed simultaneously with or separate from the bonding (welding) of the layers. Any known method for welding can be employed. An ultrasonic vibration can be applied to the strip partially along the outline of the garment, which causes the material to be molten. As an alternative, a heat generating body of the shape corresponding to the outline of the garment is shaped from a mould, which is made contact with the strip, which causes the latter to be molten and welded.

DESCRIPTION OF ATTACHED DRAWINGS

DESCRIPTION OF PREFERRED EMBODIMENTS

Now, embodiments of the present invention will be explained with reference to attached drawings.

Figure 1:
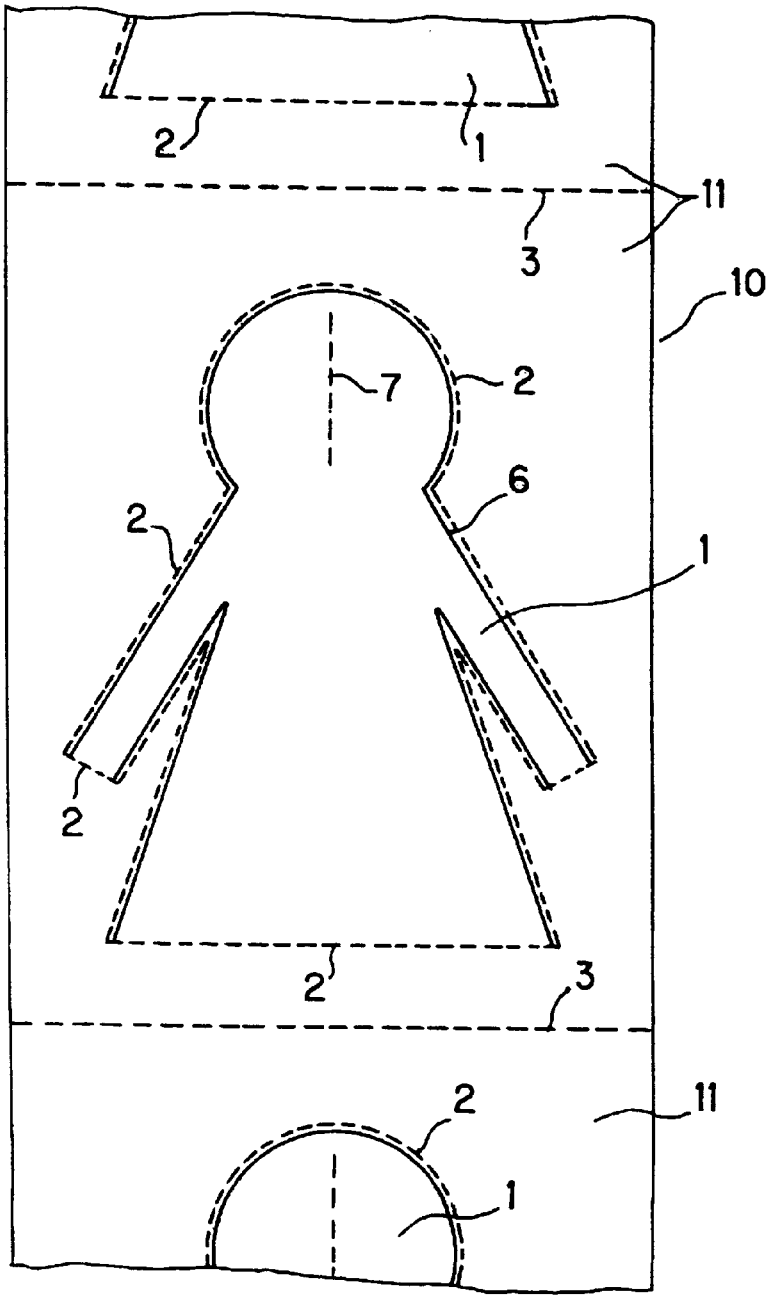
FIG. 1 is a plan view of a first embodiment of a strip according to the invention prior to a separation of a poncho therefrom.
Figure 2:
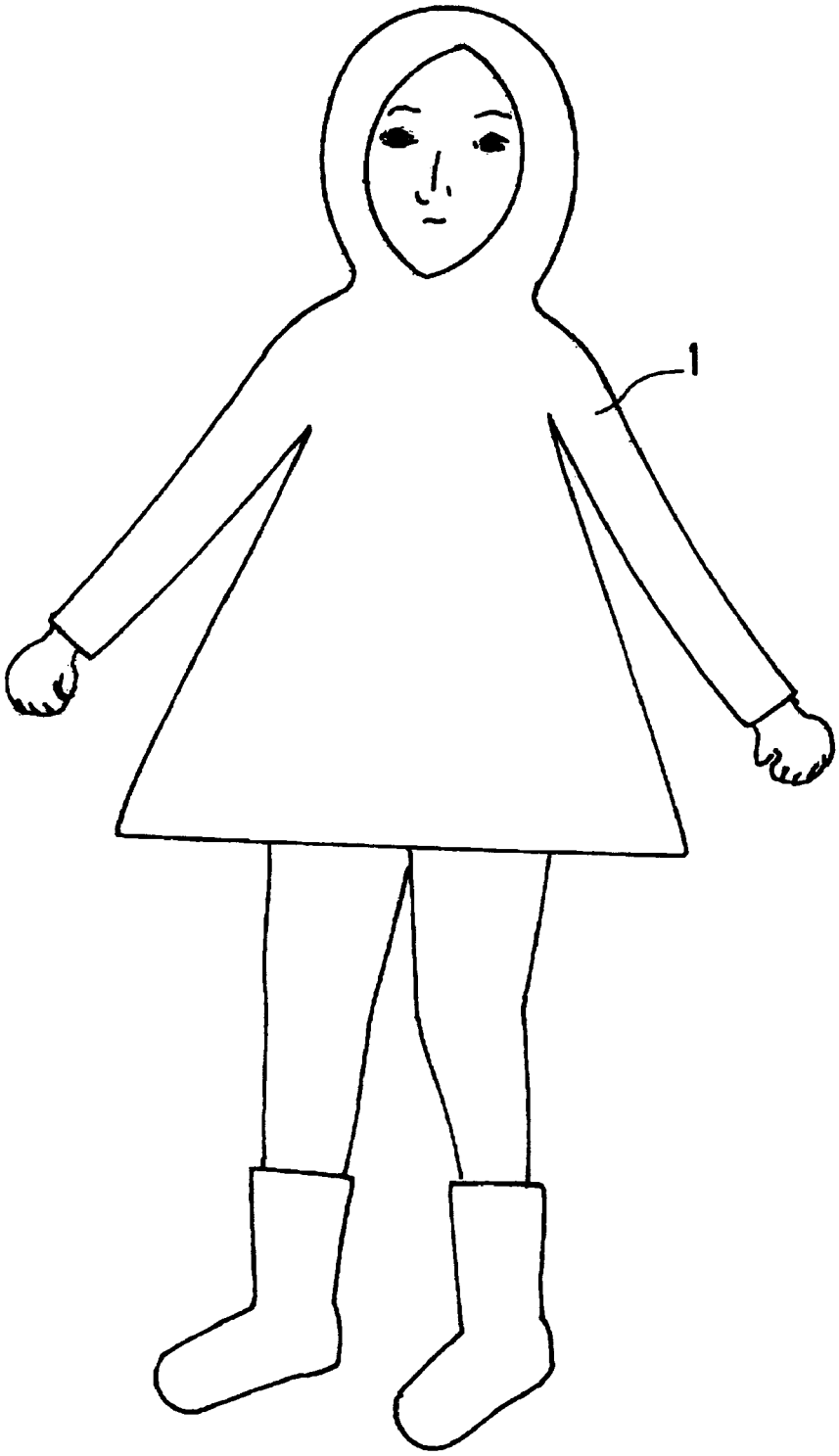
FIG. 2 is a schematic view illustrating a use of the poncho in FIG. 1.

In FIG. 1, a reference numeral 10 is a strip for production therefrom rain ponchos. The strip 10 has a plurality of units 11 which are repeated along the length of the strip 10. The strip 10 is, at each of units 11, formed with a rain poncho 1. The strip 10 is formed as a tubular film which is flattened so as to provide two layers, which are press contacted under a heat and thermally welded along outlines of the rain ponchos at locations 6 except locations where sleeves and hemline are formed. The strip 10 is provided with intermittent cut lines 2 which extend along the contour line (outline) of the garments while spaced slightly outward therefrom. The one of the layers constructing the strip 10 is, at the location of a hood, provided with a cut line 7, which allow a face of a wearer to be exposed. During the use, these intermittent cut lines 2 and 7 are fully broken, thereby separating a poncho from the strip 10. FIG. 2 shows the poncho 1 worn by a wearer.

In view of the above, it will be clear that the present invention makes it possible that simplified type rain ponchos can be easily produced at a low cost.

As shown in FIG. 1, between units 11 which are adjacent with each other, notched lines 3 extending transversely are formed. By the provision of the notched lines 3, from the leading end of the strip 10, the unit 11 on which a rain poncho is formed can be easily separated. In other words, for each of the units 11, a supply of a rain poncho to a customer can be done under a very simple way.

A customer who purchased the unit 11 can bring, with him or her, the unit 11 under a rolled or folded condition. When it is to be used, a poncho 1 is separated from the unit 10 by braking the intermittent cut lines 2, which allows the poncho 1 to be worn by a wearer.

The strip 10 on which the units 11 for the ponchos 1 are made of a thin film of water repellent nature as well as a compost nature, such as those based on polypropylene or polyvinylidene chloride. The film is, desirably, formed as a tubular shape which is flattened so that it has superimposed layers which are thermally bonded along outlines of garments (rain ponchos 1) and is formed with intermittent cut lines 2. Then the flattened strip 10 is taken up to a rolled condition, from which the leading end of the strip 10 is unwound and a unit 10 is separated for feeding to a customer. Thus, it is clear that a supply of garments to customers according to the present invention can be done under a highly simplified and convenient way. In the embodiment shown in FIG. 1, the cutting line 2 is formed adjacent to the outline of garments 1. As an alternative, the bonding (welding) between the superimposed layers is done along the width astride the outline of the garment, and the cutting line is formed within the width of the bonded portions.

Figure 3:
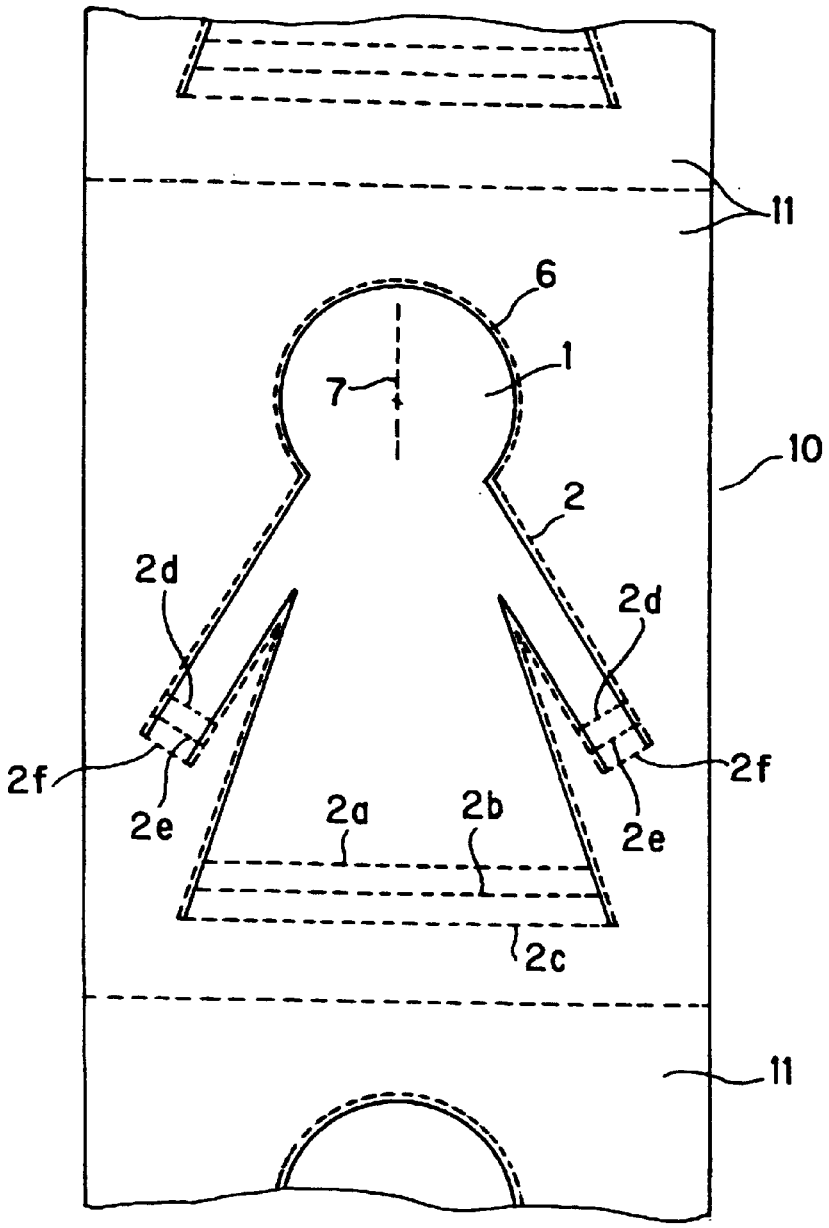
FIG. 3 is a plan view of a second embodiment of a strip according to the present invention prior to a separation of a poncho of a desired size therefrom.

In a second embodiment shown in FIG. 3, in order to make garments to be matched to wearers of various sizes, a plurality of parallel cut lines 2*a,* 2*b* and 2*c* and 2*d,* 2*e* and 2*f* are formed along the hemline and sleeve opening, respectively. Thus, a step like adjustment of a body length as well as sleeve length is realized. Namely, in accordance with measured total length as well as sleeve length of the wearer, desired cut lines from 2*a,* 2*b* and 2*c* as well as from 2*d,* 2*e* and 2*f* are selected and cutting is done along the selected cutting lines.

Figure 4:
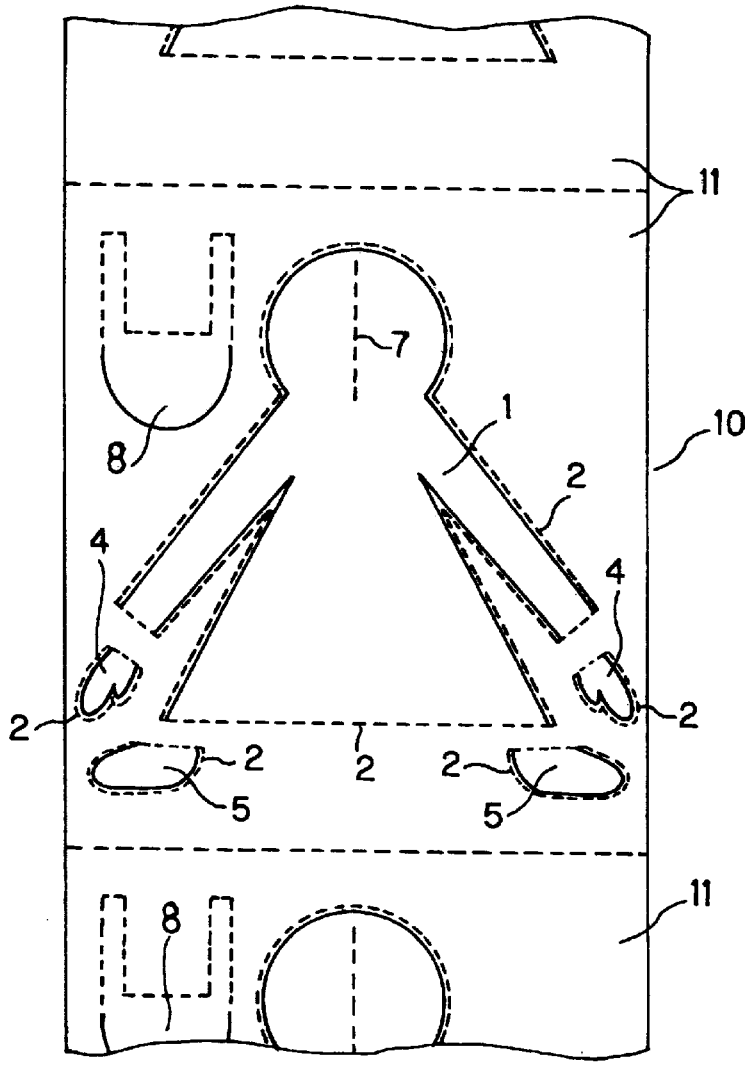
FIG. 4 is a plan view of a third embodiment of a strip according to the present invention prior to a separation of a poncho as well as its various attachments therefrom.

The simplified type of poncho according to the present invention is not only intended for use when going to an excursion or practicing a sport, such as a mountain climbing or golfing but also for use in a disaster such as typhoon, a heavy rain, a flood or an earthquake. For such a kind of use of a poncho, it is desirable that some attachment parts for such uses are simultaneously provided. In view of this, a strip in the third embodiment of the present invention shown in FIG. 4 is provided with units 11, in each of which, in addition to the rain poncho 1, attachment parts for the garment, such as gloves 4, shoe covers 5 and a bag 8 are formed at the marginal area in the similar way as explained with reference to the first embodiment. Namely, at these additional parts, the superimposed layers are thermally bonded (welded) along outlines of the parts.

What is claimed is:

1. A strip for cutting therefrom garments, comprising:

at least two superimposed layers extending in a direction of a length;

a plurality of units on the strip arranged along the length thereof, said units being separable with each other;

welded portions provided at each of said units, whereat the superimposed layers are, along an outline of a garment, at least partially, thermally welded with each other;

a cutting line provided along each of the outlines;

thereby providing garments in a sequential manner by allowing the strip to be cut under unit to unit basis and by, in each unit, separating a garment by cutting along the respective cutting line, and;

second cutting lines in each of units, said second cutting lines being parallel with each other and being provided at the area close to sleeve ends and/or to tail of a garment, said second cutting lines extending along substantially entire width of the sleeve ends and/or tail, thereby allowing a desired sleeve length adjustment and/or body length adjustment by cutting of a garment along selected lines in accordance with a size of a wearer.

2. A strip for cutting therefrom garments, comprising:

at least two superimposed layers extending in a direction of a length;

a plurality of units on the strip arranged along the length thereof, said units being separable with each other;

main welded portions provided at each of said units, whereat the superimposed layers are, along an outline of a garment, at least partially, thermally welded with each other;

a cutting line provided along each of the outlines;

thereby providing garments in a sequential manner by allowing the strip to be cut under unit to unit basis and by, in each unit, separating a garment by cutting along the respective cutting line, and;

additional welded portions at portions marginal from said main welded portions, each of said additional welded portions connecting thermally the superimposed layers with each other along an outline, which corresponds to that of an attachment article such as gloves, a shoe's cover or a bag, thereby allowing at least one attachment article to be separated from the portion of the strip marginal from the garment.

* * * * *

UNITED STATES PATENT AND TRADEMARK OFFICE

CERTIFICATE OF CORRECTION

PATENT NO. : 6,327,711 B1
DATED : December 11, 2001
INVENTOR(S) : Toshio Fujiwara It is certified that error appears in the above-identified patent and that said Letters Patent is hereby corrected as shown below:

Title page,
Item [73], Assignee, the name of the Assignee is incorrect. Please correct the Assignee to read as follows:

-- [73] Assignee: Kabushiki Kaisha Miyake Design Jimusho, Tokyo (JP) --

Signed and Sealed this

Sixteenth Day of April, 2002

*Attest:*

*Attesting Officer*

JAMES E. ROGAN
*Director of the United States Patent and Trademark Office*